US006272720B1

(12) United States Patent
Lövgren et al.

(10) Patent No.: US 6,272,720 B1
(45) Date of Patent: Aug. 14, 2001

(54) SWEEPING MACHINE

(75) Inventors: Gert Axel Lövgren, Lund; Karl Thorbjorn Haugen, Blentarp, both of (SE)

(73) Assignee: DISAB Vacuum Technology AB, Lund (SE)

( * ) Notice: Subject to any disclaimer, the term of this patent is extended or adjusted under 35 U.S.C. 154(b) by 0 days.

(21) Appl. No.: 09/421,530

(22) Filed: Oct. 20, 1999

Related U.S. Application Data

(63) Continuation of application No. PCT/SE98/00725, filed on Apr. 22, 1998.

(30) Foreign Application Priority Data

Apr. 23, 1997 (SE) ..... 9701520
Apr. 22, 1998 (SE) ..... 9800725

(51) Int. Cl.[7] ..... E01H 1/08
(52) U.S. Cl. ..... 15/355; 15/340.4; 15/374
(58) Field of Search ..... 15/340.4, 374, 15/355, 356, 340.3

(56) References Cited

U.S. PATENT DOCUMENTS 293,209 * 2/1884 Herron ..... 15/374 X
1,417,231 * 5/1922 Deweese ..... 15/374 X
1,560,612 * 11/1925 Sims ..... 15/374 X
1,615,348 * 1/1927 Schroeder ..... 15/374 X
3,436,788 * 4/1969 Tammy ..... 15/340.3 X
3,605,170 * 9/1971 Hank et al. ..... 15/340.3 X
4,620,341 * 11/1986 Rigby ..... 15/340.3 X
5,542,148 * 8/1996 Young ..... 15/340.3 X

* cited by examiner

*Primary Examiner*—Chris K. Modre
(74) *Attorney, Agent, or Firm*—Browdy and Neimark

(57) ABSTRACT

A sweeping machine composed of a brush assembly (1) and a suction assembly (5, 7, 9) sucking dirt that has been brushed off a ground surface. The brush assembly (1) has two elongate, cylindrical brushes (1) which are symmetrically arranged on either side of the travelling direction (K) and have radial bristles and a horizontal drive shaft (3) for rotation of the brushes. The drive shafts (3) extend transversely of the travelling direction and make a positive acute angle with the transverse direction, and the ends of the brushes (1) facing each other are arranged at a distance from each other. The brush assembly (1) is enclosed in a downwardly open housing (2) whose lower edge is formed of an elastic skirt (15) arranged to drag its free edge along the ground surface. The suction assembly has a suction nozzle (5) which is connectible to a suction device (7) supported by a vehicle (8). The suction nozzle (5) is elongate and extends transversely of the travelling direction (K) and behind the brushes (1). The suction nozzle (5) is formed of a casing which is open downwards and whose lower edge is formed of an elastic skirt (16) arranged to drag its free edge along the ground surface. The suction duct (9) leads to the top of the suction nozzle (5) in the center of the suction nozzle. The suction nozzle (5) communicates via openings at its ends with the housing (2) of the brush assembly.

10 Claims, 3 Drawing Sheets

SWEEPING MACHINE

This application is a continuation of copending parent application No. PCT/SE98/00725, filed Apr. 22, 1998.

The present invention relates to a sweeping machine intended for sweeping a ground surface, such as streets, roads, asphalt and concrete surfaces and the like, according to the preamble to claim 1.

The currently most frequently used street sweeping machines comprise a suction fan and their brushes whirl up dust. Therefore the street is watered before the sweeping is begun. Large quantities of air are consumed.

The object of the invention is to remedy these drawbacks.

The invention gives the advantage that considerably more effective sweeping is achieved with a smaller amount of air compared with the prior-art technique. On the one hand, the ground surface is swept thanks to the inclined brushes, thereby sweeping most of the dirt towards a zone on the ground positioned between the ends of the brushes, from which zone the subsequent suction nozzle sucks up the dirt and, on the other hand, dirt that remains on the ground after brushing on either side of said zone is also sucked up by means of the suction nozzle thanks to the suction tube connection between the housing of the brush assembly and the suction nozzle. The elastic skirts on the housing of the brush assembly and the suction nozzle contribute to a great extent to the described favourable effect, said skirts dragging their lower edge along the ground and essentially sealing against the ground, such that dirt and residual dirt can be sucked up by using a small amount of air. The sealing of the skirts against the ground and the enclosing of the brushes in a tight housing connected to the suction nozzle means also, or on the other hand, that essentially no dirt (dust) is emitted to the atmosphere in consequence of the brushing.

In a preferred embodiment, the brushes are hingedly suspended from the carriage frame as is also the suction nozzle, such that both the brushes and the suction nozzle can follow irregularities in the ground surface.

In one more preferred embodiment, the frame of the carriage is divided into two parts, such that the brushes and the suction nozzle follow the irregularities of the ground surface, independently of each other.

Figure 1:
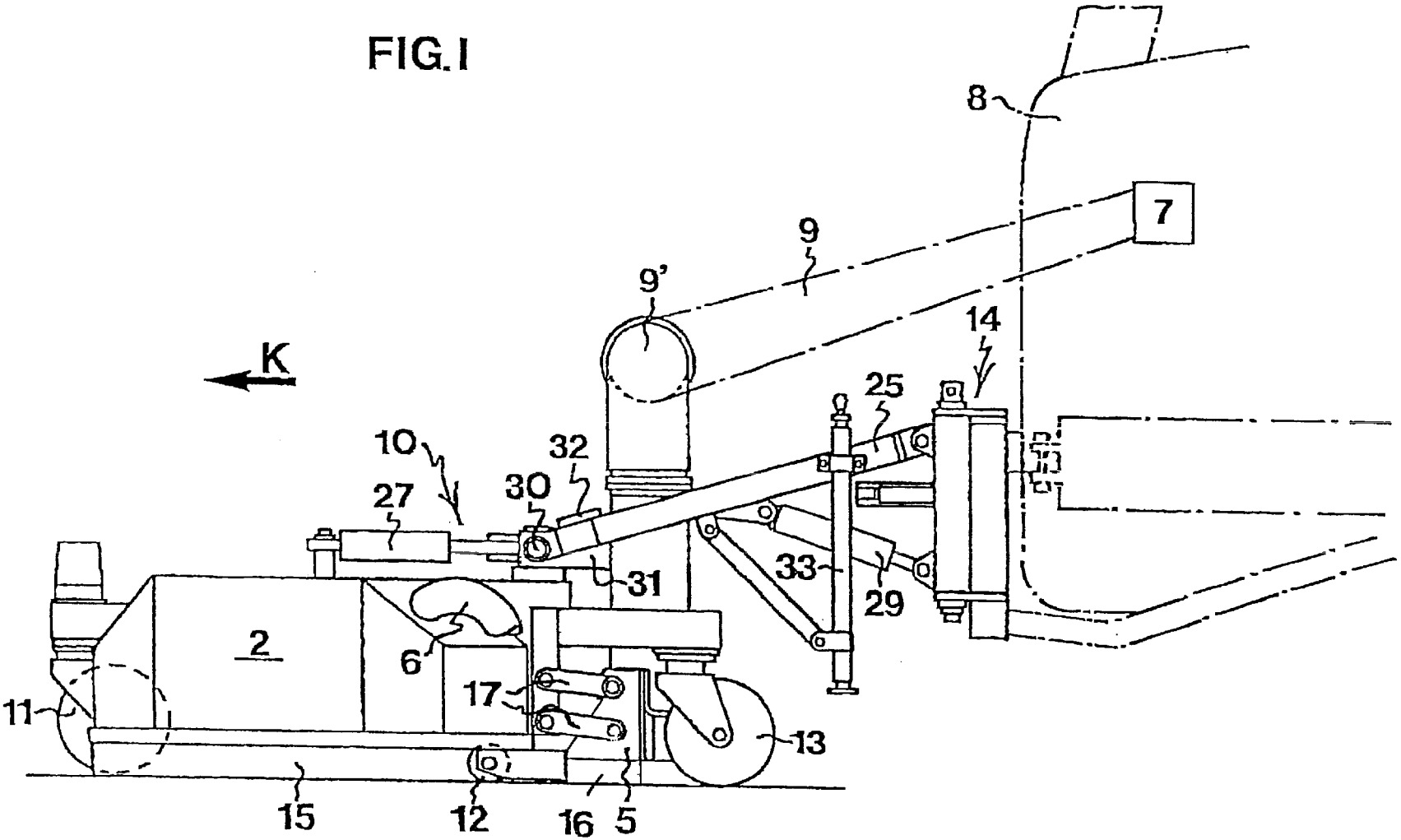
Figure 2:
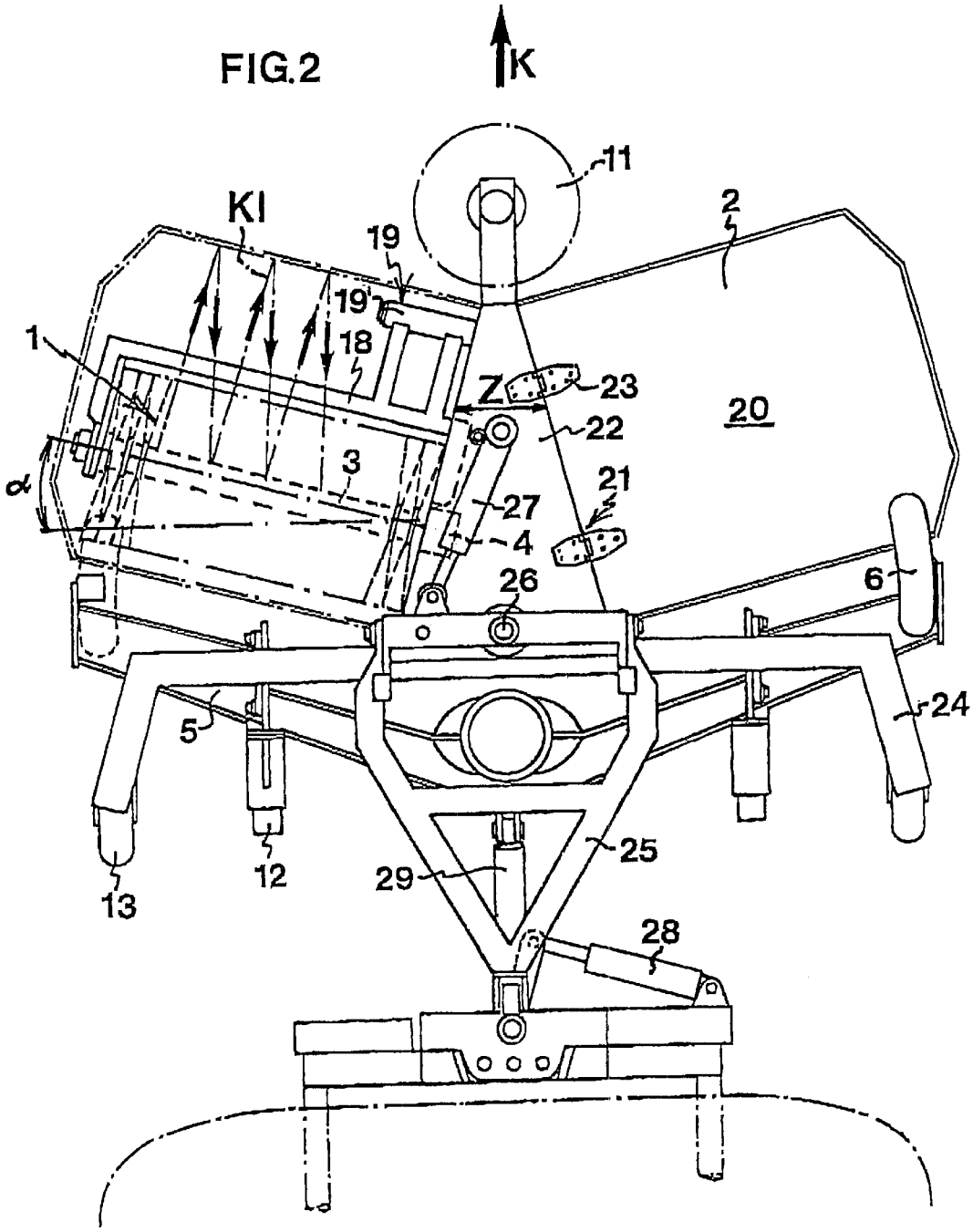
Figure 4:
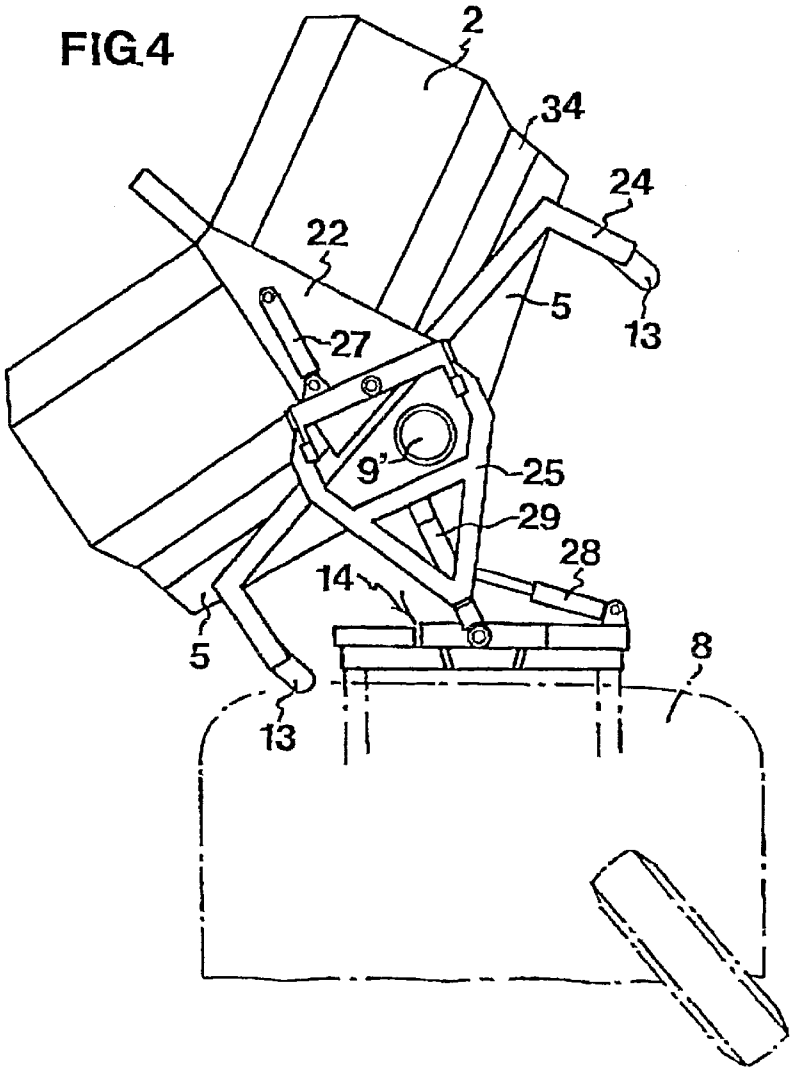
Figure 3:
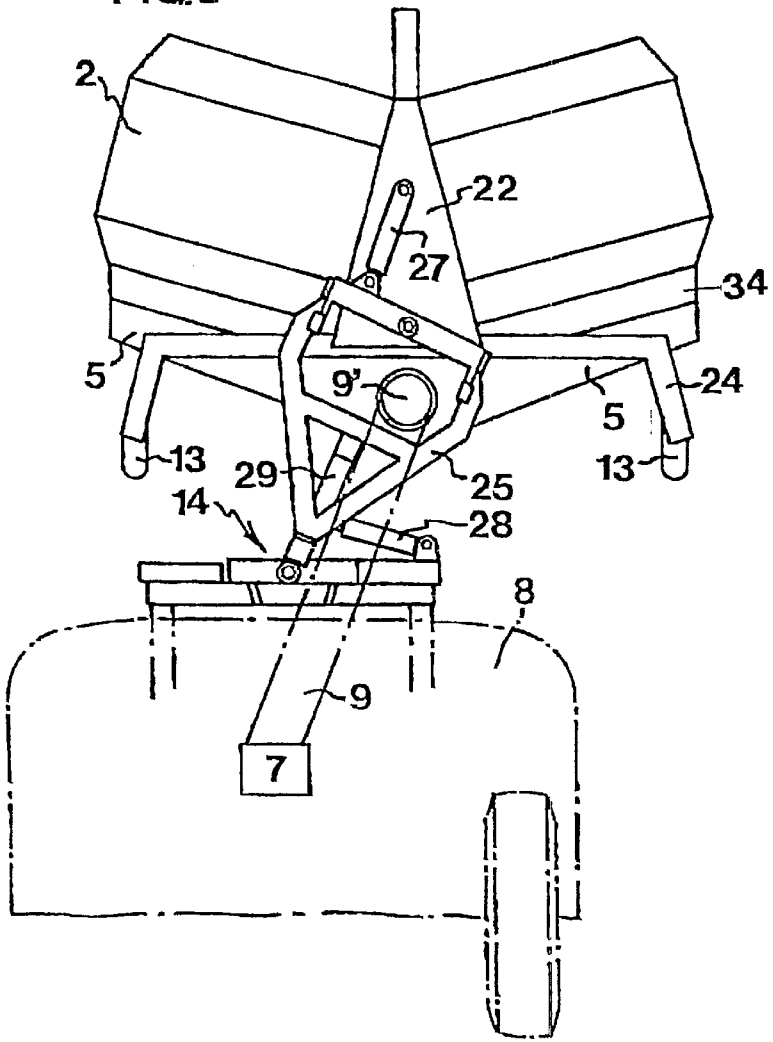

Further advantageous embodiments are evident from the dependent claims and the following specification which describes a preferred embodiment of the invention with reference to the accompanying drawings, in which FIG. 1 is a side view of the sweeping machine connected at the front to a schematically indicated vehicle, FIG. 2 is a top plan view of the sweeping machine in FIG. 1, and FIGS. 3 and 4 are also top plan views of the sweeping machine, illustrating the operability thereof.

The illustrated embodiment of the sweeping machine according to the invention comprises, as essential components seen in the travelling direction of the machine, two brushes 1 which are enclosed in a brush housing 2 and are each rotationally driven with a horizontal shaft 3 by means of hydraulic motors 4, and a suction nozzle 5 which is connected to the brush housing 2 and which communicates on the one hand with the brush housing 2 via two tubes 6 and, on the other hand, with a suction assembly 7, which is only schematically shown and which is supported by a vehicle 8 provided with a hydraulic system, via a suction duct 9.

The above-mentioned components 1–6 are supported by a frame structure forming a carriage 10 with a front wheel 11 and pairs of wheels 12, 13, said carriage 10 being mechanically coupled to the vehicle 8 by means of a mechanism generally designated 14. In the embodiment shown, the carriage 10 and the coupling mechanism 14 are adapted to push the carriage 10; in an alternative embodiment, the coupling mechanism 14 can be adapted to allow pulling of the carriage 10 by means of the vehicle 8.

The brushes 1 are cylindrical and have radial bristles. Their horizontal shafts 3 extend essentially transversely of the travelling direction, by which is meant that they make a positive acute angle $\alpha$ (which can be, for instance, 15°) with the transverse direction. Their ends facing each other have an inactive distance between themselves, in which the brushes 1 thus do not perform any sweeping operation. The inclination and direction of rotation (motors 4) are such that the brushes 1 throw the dirt in the travelling direction, arrow K.

The brush housing 2 encloses the brushes 1 with a high degree of sealing. For the sealing at the bottom, against the ground, an elastic skirt 15 (made of e.g. rubber) is responsible, which is fixed to the brush housing 2 and the lower edge of this thus drags along the ground that is to be swept. This, in combination with the inclination of the brush shafts 3, results in thrown-away dirt being thrown back against the brushes 1 and being gradually collected in a zone Z midway between the brushes 1, whose width largely corresponds to said inactive distance. The path of the dirt is indicated by dashed arrows K1.

This dirt zone is sucked away by means of the subsequent suction nozzle 5, the suction duct 9 and the suction assembly 7. The opening 9' of the suction duct 9 at the top of the suction nozzle 5, which has an essentially inverted U section closed at the ends, is arranged in the centre of the suction nozzle 5, and the suction nozzle 5 has a width, transversely of the travelling direction, corresponding to the width of the brush housing 2 in the same direction. The lower part of the suction nozzle 5 is formed of an elastic skirt 16, with the lower edge of which the suction nozzle drags along the ground. The suction force of the suction nozzle 5 is thus greatest just in front of the zone Z, to which the dirt has been brushed.

It goes without saying that in operation the brushes 1 also whip dirt into pits in the ground and miss some of the dirt, i.e. all the dirt does not go as described above to the central zone. It is for the purpose of taking care of this residual dirt that the suction connection between the brush housing 2 and the suction nozzle 5 is arranged via the tubes 6. These lead to the suction nozzle 5 at the ends of the top of the suction nozzle 5, spaced from the central opening 9' of the suction duct 9 in the suction nozzle 5, and lead at their other end to the brush housing 2 at the top thereof, close to the ends of the brush housing 2.

Normal ground (e.g. a road) is in most cases not entirely even. With a view to taking care of the dirt of these irregularities as well, i.e. ensuring the cleaning of uneven ground as well, that would cause gaps between the sealing skirts 15 and 16 and the ground, the brush housing 2 and the suction nozzle 5 are interconnected by means of a parellel link mechanism 17 arranged to allow vertical movement of the suction nozzle 5, which rolls on the pair of wheels 13 which is a pair of caster wheels, and the pair of wheels 12, which is stationary, relative to the brush housing 2. The brush housing 2 also rolls on the single caster wheel 11 which is centrally arranged. For the same purpose, the brush shafts 3 are suspended from a yoke 18, which is hingedly mounted at 19 on he frame of the carriage.

The brush housing 2 has preferably openable parts 20, in this case top parts, which allow access to and inspection or exchange of the brushes 1.

Now follows a description of some of the components of the frame of the carriage, which allow all-round operability of the sweeping machine.

The frame of the carriage comprises a first frame part 21, which constitutes a central part 22 of the brush housing 2, to which the openable parts 20 of the brush housing are attached by means of hinges 23. The first frame part 21 also supports the pins 19' for the hinge connection of the brushes 1 with the yoke 18. Moreover, the first frame part 21 comprises a crossbar 24, to which the suction nozzle 5 is fixed.

A second frame part 25 is hingedly mounted on the first frame part 21 on a vertical central pin 26 thereof and is further connected to the first frame part 21 by means of a piston-and-cylinder assembly 27 with articulated fixing points. The second frame part 25 is at its rear end suspendable from the vehicle 8 for horizontal pivoting.

Thus, the carriage is pivotable sideways from a certain travelling direction, as is shown in FIGS. 3 and 4, in which case the outwards pivoting is controlled by means of a piston-and-cylinder assembly 28, and the brush housing 2 as well as the suction nozzle 7 are pivotable horizontally means of the piston-and-cylinder assembly 27 relative to the second frame part 25.

Preferably there is also a possibility of raising the entire carriage from the ground, which is achieved on the one hand by means of a further piston-and-cylinder assembly 29 fixed to the second frame part 25 and to the coupling mechanism 14 and, on the other hand, by means of an articulated connection of the second frame part 25 to the first frame part 21 at a pivot point 30, also for pivoting vertically. Stop lugs 31 and 32 are arranged on the frame parts 25 and 21 to limit the vertical pivoting movement, and a supporting leg is shown at 33.

By means of the described hinge arrangements, the carriage can thus be steered through curves and can sweep in a laterally displaced position relative to the vehicle, thereby efficiently sweeping, for instance, the edge of a road.

The motors 4 and the piston-and-cylinder assemblies as described are hydraulically operated by means of the hydraulic system of the vehicle, and suitable control devices are of course arranged in the system. In the embodiment illustrated, the engines 4 are synchronously operated by being connected in series.

Reference numeral 34 refers to a flexible cloth, which seals the gap between the suction nozzle 5 and the brush housing 2 so as to achieve an improved vacuum effect in the suction nozzle 5 and, thus, in the brush housing 2.

It goes without saying that the suction nozzle 5 can be incorporated in the brush housing 2, whereby the tubes 6 will not be necessary, merely openings at the ends of the suction nozzle at the top or in the end walls.

What is claimed is:

1. A sweeping machine comprising a brush assembly (1) and a suction assembly (5, 7, 9) for sucking dust that has been brushed off a ground surface while the machine travels in a travelling direction (K), wherein a) the brush assembly (1) comprises two elongate, cylindrical brushes that are symmetrically arranged on either side of a line that extends in the travelling direction (K), each of said brushes having radial bristles and a drive shaft (3) arranged horizontally for rotating the brushes, a1) each said drive shaft (3) extends essentially in a transverse direction relative to the travelling direction (K) and forms a positive acute angle ($\alpha$) with the transverse direction, and the brushes have respective ends that face one another at a distance from one another, a2) said machine further comprises a downwardly open housing (2) that encloses said brush assembly (1) and that has a lower edge, and a first elastic skirt (15) disposed at the lower edge and having a free edge arranged to drag along the ground surface that is to be swept, b) the suction assembly comprises a suction nozzle (5), a suction device (7) arranged to be supported by a vehicle (8), and a suction duct (9) connecting the suction nozzle (5) to the suction device (7), b1) said suction nozzle (5) is elongate, extends transversely of the travelling direction (K) and is located behind the brushes, with respect to the travelling direction (K), b2) said suction nozzle (5) is formed of a casing that is open downwards and that has a second elastic skirt (16) that forms a lower edge of the casing, said second elastic skirt having a free edge that is arranged to drag along the ground surface to be swept, c) the suction nozzle (5) has a top with a center and the suction duct (9) leads to the center at the top of the suction nozzle (5), d) the suction nozzle (5) has ends provided with openings that communicate with the interior of said housing (2), and e) said machine further comprises a carriage (10) that carries the housing (2) and the suction nozzle (5), said carriage having wheels (11, 12, 13) and means (14) for connecting said machine to the vehicle (8).

2. The sweeping machine as claimed in claim 1, wherein said carriage (10) includes a frame (21, 25) constructed to allow relative vertical motion between the suction nozzle (5) and the housing (2).

3. The sweeping machine as claimed in claim 2 further comprising support means supporting the drive shafts (3) to allow pivoting of the brushes (1) in a vertical direction.

4. The sweeping machine as claimed in claim 3, wherein the housing (2) and the suction nozzle (5) are horizontally pivotable together, and the vehicle has a first hydraulic system that is operative for horizontally pivoting the housing (2) and the suction nozzle (5).

5. The sweeping machine as claimed in claim 4, wherein the housing (2) and the suction nozzle (5) are vertically pivotable together, and the vehicle has a second hydraulic system that is operative for vertically pivoting the housing (2) and the suction nozzle (5).

6. The sweeping machine as claimed in claim 5, wherein the housing (2) and the suction nozzle (5) are separate components, and said suction assembly further comprises at least one tube (6) connected between at least one of said openings at the ends of the suction nozzle (5) and the housing for establishing communication between the suction nozzle (5) and the interior of said housing (2).

7. The sweeping machine as claimed in claim 1 further comprising support means supporting the drive shafts (3) to allow pivoting of the brushes (1) in a vertical direction.

8. The sweeping machine as claimed in claim 1, wherein the housing (2) and the suction nozzle (5) are horizontally pivotable together, and the vehicle has a hydraulic system that is operative for horizontally pivoting the housing (2) and the suction nozzle (5).

9. The sweeping machine as claimed in claim 1, wherein the housing (2) and the suction nozzle (5) are vertically pivotable together, and the vehicle has a hydraulic system that is operative for vertically pivoting the housing (2) and the suction nozzle (5).

10. The sweeping machine as claimed in claim 1, wherein the housing (2) and the suction nozzle (5) are separate components, and said suction assembly further comprises at least one tube (6) connected between at least one of said openings at the ends of the suction nozzle (5) and the housing for establishing communication between the suction nozzle (5) and the interior of said housing (2).

* * * * *